United States Patent [19]

Clark

[11] Patent Number: 4,472,835

[45] Date of Patent: Sep. 25, 1984

[54] REVERSIBLE THERMAL VEST GARMENT

[76] Inventor: William H. Clark, 4284 E. State St., Sharon, Pa. 16146

[21] Appl. No.: 444,800

[22] Filed: Nov. 26, 1982

[51] Int. Cl.[3] ..... A41B 1/04

[52] U.S. Cl. ..... 2/102; 2/DIG. 2

[58] Field of Search ..... 2/DIG. 2, 108, 93, 97, 2/102

[56] References Cited

U.S. PATENT DOCUMENTS

| | | | |
|---|---|---|---|
| 1.421,131 | 6/1922 | Abrams | 2/102 |
| 2,233,567 | 3/1941 | Levinsohn | 2/DIG. 2 |
| 2,263,544 | 11/1941 | Rosenstein | 2/DIG. 2 |
| 4,100,620 | 7/1978 | Peodraro | 2/102 |
| 4,338,686 | 7/1983 | Bell | 2/DIG. 2 |

*Primary Examiner*—Doris L. Troutman

*Attorney, Agent, or Firm*—Harpman & Harpman

[57] ABSTRACT

A garment, such as a vest, has a removable, reversible inner liner of insulating material incorporated a perforated reflective film, the inner liner being formed in front and back portions detachably connected to one another in the shoulder area and accessible through openings in the garment. A continuous slide fastener is provided for joining the front portions of the garment which is usable with or without the removable, reversible inner liner and when used with the inner liner the same may be reversed to position the reflective film toward the wearer's body or alternately away from the wearer's body as desired.

5 Claims, 4 Drawing Figures

REVERSIBLE THERMAL VEST GARMENT

BACKGROUND OF THE INVENTION

1. Field of the Invention:

This invention relates to garments, such as vests, which are particularly useful for outdoor wear in cold climates.

2. Description of the Prior Art:

A waterproof vest for hunters is disclosed in U.S. Pat. No. 2,083,121, the vest being designed to be worn over a hunting jacket so as to provide a brightly colored, waterproof additional garment.

U.S. Pat. No. 3,997,982 discloses a training vest, or the like, which is provided with replaceable practice panels to permit children or handicapped purposes to develop manipulative skills in operating various clothing fasteners. The practice panels are positioned adjacent to the front opening of the training vest to define the portions thereof carrying the actual fasteners.

The present invention comprises an attractive vest-like garment formed of inner and outer fabric portions joined to one another around the arm holes and the neck and front openings and with the lower edges of the inner and outer portions finished separately to form a cntinuous access opening into the area between the inner and outer fabric portions and into which two sections of a removable reversible inner liner may be inserted or removed therefrom.

SUMMARY OF THE INVENTION

A reversible thermal vest garment has inner and outer fabric layers attached to one another only at the arm holes and the neck and front portions of the garment together with a removable reversible inner liner of insulating material incorporating perforated reflective film.

DESCRIPTION OF THE PREFERRED EMBODIMENT

Figure 1:
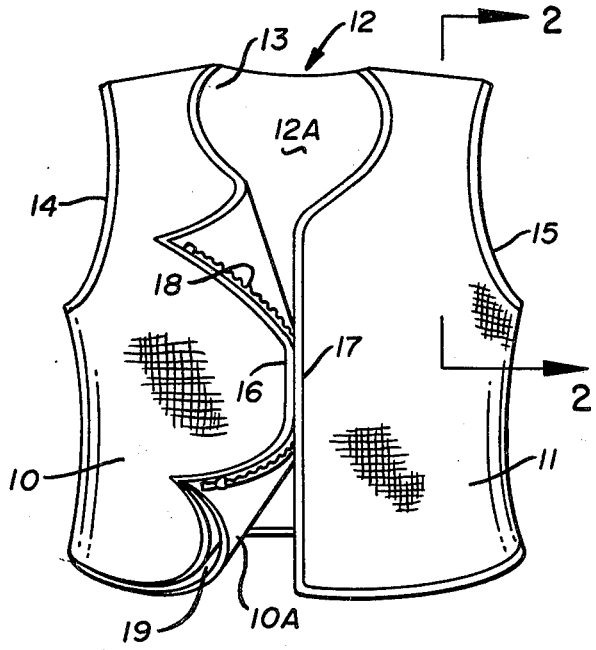
FIG. 1 is a front plan view of the reversible thermal vest garment.

By referring to FIG. 1 of the drawings, it will be seen that a vest-like garment has been illustrated and comprises right and left front portions 10 and 11 respectively and a back portion 12 arranged to define a neck opening 13 and arm holes 14 and 15 respectively. The right and left front portions 10 and 11 have parallel vertical edges 16 and 17 and a continuous fastener 18 is positioned along the edges 16 and 17 as will be understood by those skilled in the art.

The right and left front portions 10 and 11 respectively and the back portion 12 are formed of two layers of suitable fabric attached to one another only along the front edges 16 and 17, the neck opening 13, and around the arm holes 14 and 15. As best shown in FIG. 1 of the drawings, the outermost layer of the two layers of suitable fabric is shown separated from the inner layer 10A by a space 19 and it will be understood that this space 19 is accessible continuously around the lower edge of the vest-like garment between the lower corners of the front edges 16 and 17 respectively.

Figure 2:
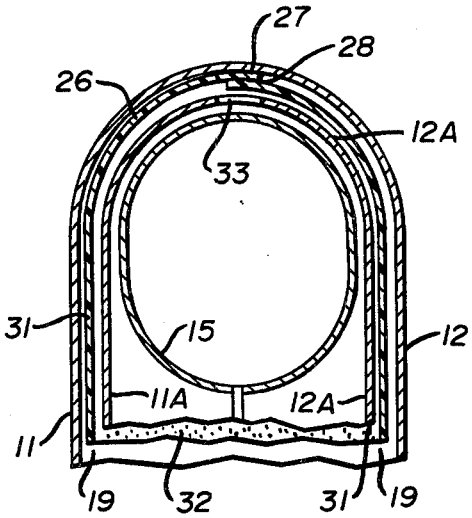
FIG. 2 is an enlarged vertical section on line 2—2 of FIG. 1.

In FIG. 2 of the drawings, the vertical enlarged section on line 2—2 of FIG. 1 has been exploded somewhat to illustrate the space 19 between the outer layer forming the left front portion 11 and the inner layer 11A and it will be seen that the back portion 12 is separated by the continuing space 19 from the back portion of the inner layer 12A.

Additionally, in FIG. 2 of the drawings, the upper portions of a removable reversible inner liner may be seen positioned in the space 19. The inner liner is illustrated in front plan view in FIG. 3 of the drawings and a portion thereof in enlarged section in FIG. 4 of the drawings.

Figure 3:
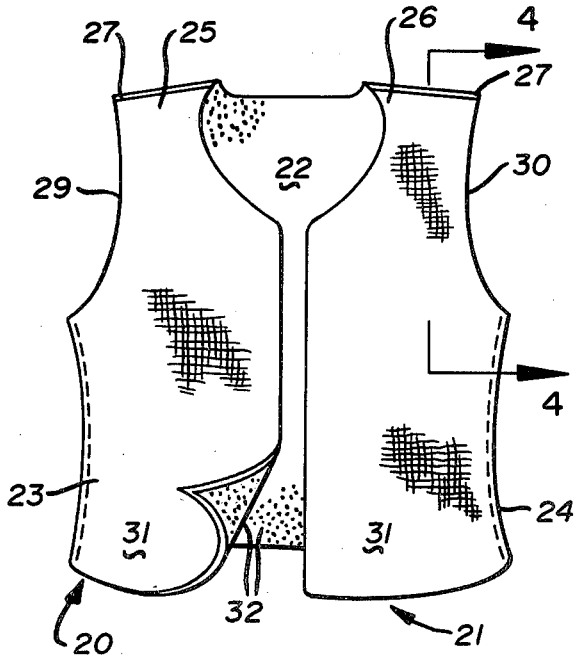
FIG. 3 is a front view of a removable reversible inner liner insertable in the garment shown in FIG. 1.
Figure 4:
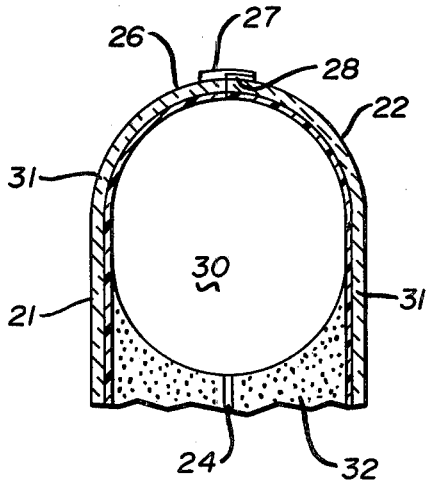
FIG. 4 is an enlarged vertical section on line 4—4 of FIG. 3.

By referring to FIG. 3 of the drawings, it will be seen that the removable reversible inner liner comprises right and left front portions 20 and 21 and a back portion 22, the portions being joined to one another by vertical seams 23 and 24 at their sides and loosely positioned in overlapping relations at their uppermost portions 25 and 26. Sections of a continuous fastener, such as VELCRO, as indicated by the numerals 27 and 28 are attached to the uppermost portions 25 and 26 of the inner liner so that these portions can be joined to one another in the shoulder areas.

Still referring to FIG. 3, it will be seen that the right front portion 20, the left front portion 21 and the back portion 22 of the removable reversible inner liner part of the garment define armholes 29 and 30. The inner liner comprises a thin section of a batting-like material 31 incorporating on one side thereof a perforated aluminized film 32. Such material is commercial available as GORE-TEX, a product of King Sealy Thermos Company.

By referring again to FIG. 2 of the drawings, it will be seen that the enlarged sections includes an appropriate section of the inner fabric layer 12A which forms part of the back portion 12 of the garment as seen in FIG. 1 of the drawings and that openings 33 are formed in the inner layer 12A in the uppermost shoulder portions thereof to provide access into the space 19 to facilitate the fastening together of the upper portions 26 of the removable reversible inner liner.

It will thus be seen that a reversible thermal vest garment has been disclosed which may be worn as an attractive vest-like garment and comprising only the permanent assembly of the right and left front portions 10 and 11 and back portion 12A as seen in FIG. 1 of the drawings. In colder weather the inner liner including the right and left front portions 20 and 21 and the back portion 22 may be inserted into the space 19 between the two fabric layers, moved upwardly into conforming position and the shoulder portions 26 thereof joined to one another by the continuous fasteners 27 and 28 which are accessible through the openings 33 in the shoulder areas of the inner one of the two fabric layers of the vest. In such position with the perforated reflective film on the innermost surface thereof facing the body of the wearer, radiant body heat will be reflected back toward the wearer, which with the thermal insulating character of the batting-like material to which the reflecting film is affixed, gives the wearer an unusual choice of warmth retention qualities. By separating the shoulder portions of the inner liner and removing it and reversing it and reinstalling it, the reflective film will be away from the body of the wearer, while the thermal insulation of the batting-like layer remains.

It will thus be seen that a novel and highly efficient reversible thermal vest-like garment has been disclosed and it will occur to those skilled in the art that the vest can be designed so as to be form fitting and if necessary include elastic panels to insure desirable shape. It will also occur to those skilled in the art that the vest-like garment can be provided with removable sleeves or permanently attached sleeves as desired and that the fabric used in the inner and outer layers of the garment can be chosen from the several desirable attractive fabrics commercially available.

Although but one embodiment of the present invention has been illustrated and described, it will be apparent to those skilled in the art that various changes and modifications may be made therein without departing from the spirit of the invention and having thus described my invention

What I claim is:

1. An insulating garment comprising a vest having spaced inner and outer fabric layers joined to one another only along their front edges around the neck opening therein and around the arm openings therein and defining a continuous fabric layers and a removable reversible inner liner arranged to be positioned between said inner and outer fabric layers through said continuous opening, said removable, reversible inner liner having unattached shoulder portions and separable fastener means secured thereto for securing said shoulder portions to one another so as to support said removable, reversible inner liner in the space between said inner and outer fabric layers of said vest.

2. The insulating garment of claim 1 and wherein separable fasteners are attached to the front edges of the joined inner and outer fabric layers.

3. The insulating garment of claim 1 and wherein access openings are provided in the inner fabric layer of said garment adjacent said shoulder portions of said inner liner when the same is positioned between said inner and outer fabric layers.

4. The insulating garment of claim 1 wherein said inner liner is formed of a layer of insulating material and perforated reflective film.

5. The insulating garment of claim 1 wherein said inner liner is formed of a layer of insulating material and perforated reflective film and wherein said layers of insulating material is characterized by being multiple air cell formation.

* * * * *